US009809403B2

(12) United States Patent
Yaginuma et al.

(10) Patent No.: US 9,809,403 B2
(45) Date of Patent: Nov. 7, 2017

(54) SHEET FEEDING DEVICE AND IMAGE FORMING APPARATUS

(71) Applicant: FUJI XEROX CO., LTD., Tokyo (JP)

(72) Inventors: Shinji Yaginuma, Kanagawa (JP); Tsutomu Somemiya, Kanagawa (JP); Takashi Abe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/058,246

(22) Filed: Mar. 2, 2016

(65) Prior Publication Data

US 2017/0081139 A1 Mar. 23, 2017

(30) Foreign Application Priority Data

Sep. 17, 2015 (JP) ..... 2015-183573

(51) Int. Cl.
*B65H 1/26* (2006.01)

(52) U.S. Cl.
CPC ..... *B65H 1/266* (2013.01); *B65H 2402/64* (2013.01); *B65H 2405/115* (2013.01); *B65H 2405/1122* (2013.01); *B65H 2405/121* (2013.01)

(58) Field of Classification Search
CPC ..... B65H 1/266; B65H 2402/64; B65H 2405/1122; B65H 2405/115; B65H 2405/121; A47B 88/50; A47B 2088/954; A47B 2088/951; A47B 57/408
See application file for complete search history.

(56) References Cited

U.S. PATENT DOCUMENTS

| | | | | |
|---|---|---|---|---|
| 7,546,061 | B2 * | 6/2009 | Kurokawa | B41J 13/103 101/494 |
| 8,220,297 | B2 * | 7/2012 | Palumbo | B65H 1/266 70/14 |
| 8,366,098 | B2 * | 2/2013 | Kobayashi | B65H 1/266 271/145 |
| 8,387,970 | B2 * | 3/2013 | Ubayashi | B65H 1/266 271/145 |
| 8,770,577 | B2 * | 7/2014 | Onodera | B65H 3/44 109/73 |

(Continued)

FOREIGN PATENT DOCUMENTS

| | | |
|---|---|---|
| JP | 2004-075293 A | 3/2004 |
| JP | 2007-137683 A | 6/2007 |
| JP | 2007-297170 A | 11/2007 |

OTHER PUBLICATIONS

Communication dated Jul. 31, 2017 from the State Intellectual Property Office of the P.R.C. in counterpart Application No. 201610210291.6.

*Primary Examiner* — Patrick Cicchino
(74) *Attorney, Agent, or Firm* — Sughrue Mion, PLLC

(57) ABSTRACT

A sheet feeding device includes a container including a frame, an auxiliary frame member provided on the frame so as to be slidable relative to the frame, and a front cover that covers a front side of the auxiliary frame member, the container being detachably supported in a body of the sheet feeding device; a cover member that covers a top side of the container when the container is attached to the body; and a locking unit that prevents the container attached to the body from being detached from the body when the container is locked and that enables the container to be detached from the body when the container is not locked.

9 Claims, 19 Drawing Sheets

(56) References Cited

U.S. PATENT DOCUMENTS

| | | | | |
|---|---|---|---|---|
| 2007/0251405 | A1* | 11/2007 | Kurokawa | B41J 13/103 101/494 |
| 2016/0083205 | A1* | 3/2016 | Murashima | B65H 1/266 271/171 |
| 2016/0221770 | A1* | 8/2016 | Ishii | B65H 1/266 |
| 2016/0291519 | A1* | 10/2016 | Oguri | B65H 5/26 |
| 2016/0332829 | A1* | 11/2016 | Eguchi | B65H 1/04 |

* cited by examiner

SHEET FEEDING DEVICE AND IMAGE FORMING APPARATUS

CROSS-REFERENCE TO RELATED APPLICATIONS

This application is based on and claims priority under 35 USC 119 from Japanese Patent Application No. 2015-183573 filed Sep. 17, 2015.

BACKGROUND

Technical Field

The present invention relates to a sheet feeding device and an image forming apparatus.

SUMMARY

According to an aspect of the invention, there is provided a sheet feeding device including a container including a frame, an auxiliary frame member provided on the frame so as to be slidable relative to the frame, and a front cover that covers a front side of the auxiliary frame member, the container being detachably supported in a body of the sheet feeding device; a cover member that covers a top side of the container when the container is attached to the body; and a locking unit that prevents the container attached to the body from being detached from the body when the container is locked and that enables the container to be detached from the body when the container is not locked.

BRIEF DESCRIPTION OF THE DRAWINGS

An exemplary embodiment of the present invention will be described in detail based on the following figures, wherein.

DETAILED DESCRIPTION

Figure 1:
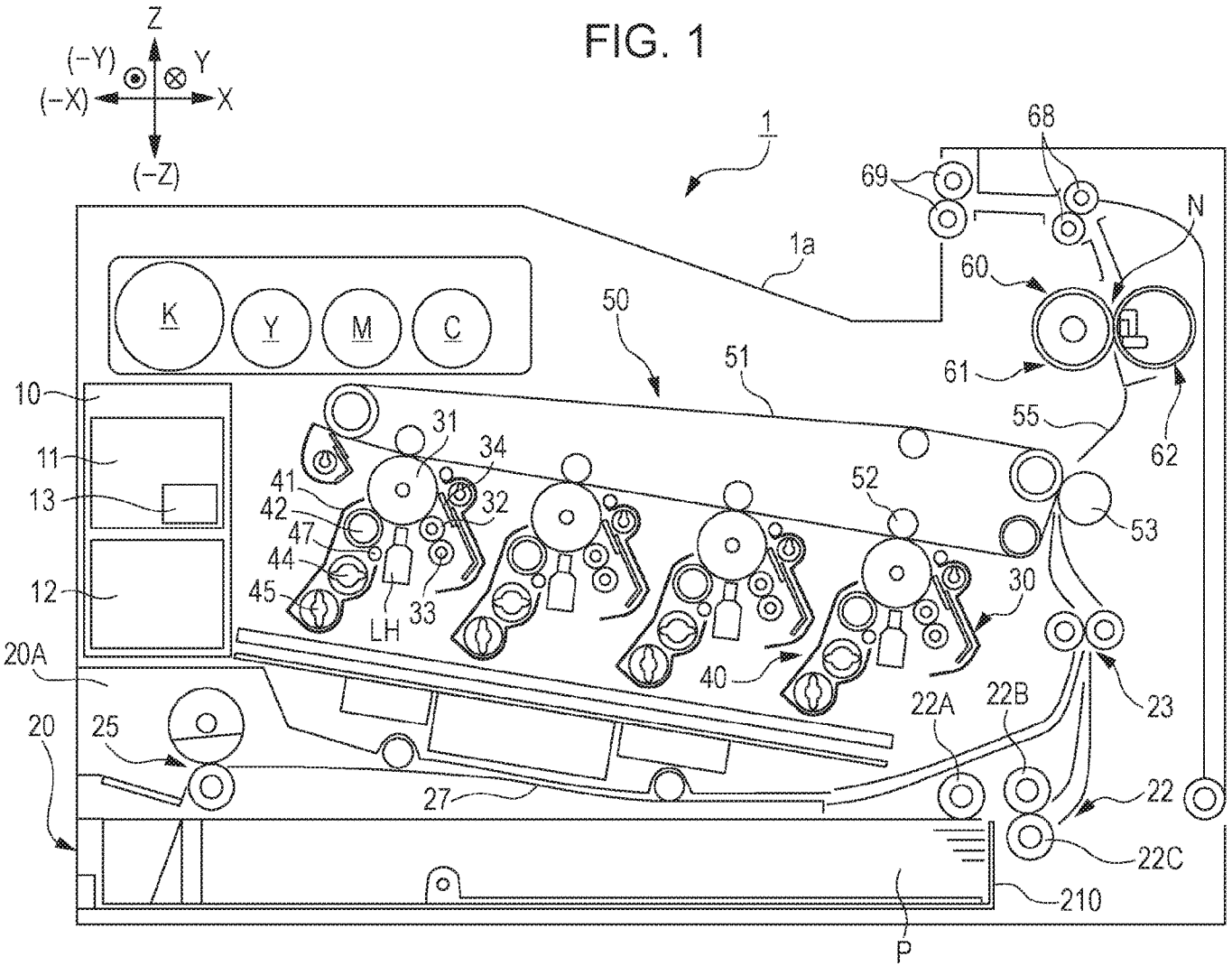
FIG. 1 is a schematic sectional view illustrating the internal structure of an image forming apparatus.

The present invention will be explained in further detail by describing an exemplary embodiment and examples with reference to the drawings. However, the present invention is not limited to the exemplary embodiment and examples.

It is to be noted that the drawings referred to in the following description are schematic, and that dimensional ratios, for example, are not equal to the actual dimensional ratios. Components other than those needed to be explained to facilitate understanding are omitted as appropriate in the drawings.

1. Overall Structure and Operation of Image Forming Apparatus

Figure 2B:
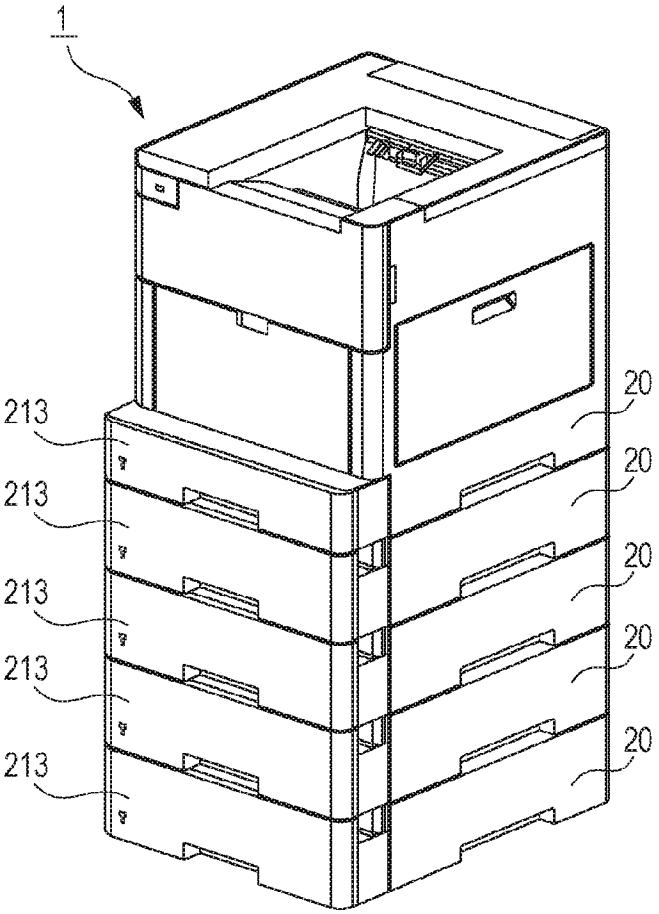
FIG. 2B is a perspective view of the image forming apparatus to which the trays are attached while the auxiliary frame members thereof are pulled out.
Figure 2A:
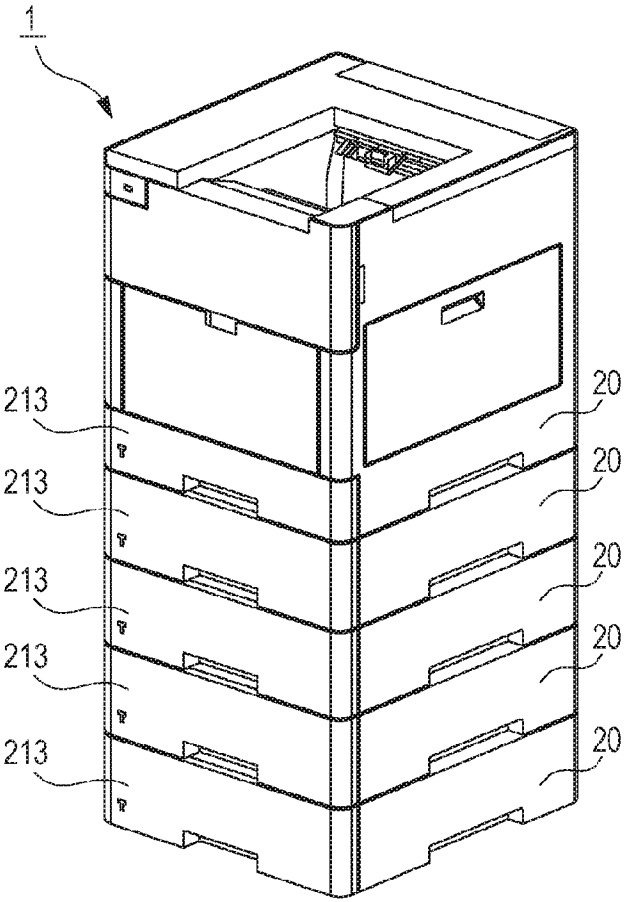
FIG. 2A is a perspective view of the image forming apparatus to which trays are attached while auxiliary frame members thereof are retracted.

FIG. 1 is a schematic sectional view illustrating the internal structure of an image forming apparatus 1 according to an exemplary embodiment. FIG. 2A is a perspective view of the image forming apparatus 1 to which trays 210 are attached while auxiliary frame members 212 thereof are retracted. FIG. 2B is a perspective view of the image forming apparatus 1 to which the trays 210 are attached while the auxiliary frame members 212 thereof are pulled out.

The overall structure and operation of the image forming apparatus 1 will be described with reference to FIG. 1.

The image forming apparatus 1 includes a control device 10, sheet feeding devices 20, photoconductor units 30, developing units 40, a transfer device 50, and a fixing device 60. An output tray 1*a*, which receives sheets P having images recorded thereon, is provided on the top surface (Z-direction-side surface) of the image forming apparatus 1.

The control device 10 includes an image-forming-apparatus controller 11 that controls the operation of the image forming apparatus 1; a controller unit 12 that prepares image data corresponding to a print request; and an exposure controller 13 that controls the on-off state of exposure devices LH.

The controller unit 12 converts print information input thereto from an external information transmission device (for example, a personal computer) into image information used to form a latent image, and outputs drive signals to the exposure devices LH at a preset timing. Each of the exposure devices LH according to the present exemplary embodiment includes an LED head in which plural light emitting diodes (LEDs) are linearly arranged in a scanning direction.

The sheet feeding devices 20 are provided in a lower section of the image forming apparatus 1. Each sheet feeding device 20 includes a tray 210, which serves as a container and contains plural sheets P, which serve as recording media. The sheets P stacked on the trays 210 are drawn one at a time from the top toward the front side (in the X direction) by a sheet-drawing unit 22, and then are transported to a nip portion of a pair of registration rollers 23.

A second sheet feeding device 20A is provided above the sheet feeding devices 20. The second sheet feeding device 20A transports sheets P drawn by a sheet drawing unit 25 toward the nip portion of the pair of registration rollers 23 along a sheet transport path 27.

The sheet feeding devices 20 are stacked in the lower section of the image forming apparatus 1 and form a tray module. Each sheet feeding device 20 may be switched between a first state (see FIG. 2A) in which the auxiliary frame member 212 of the tray 210 is retracted into a frame 211 and a second state (see FIG. 2B) in which the auxiliary frame member 212 is pulled out.

The photoconductor units 30 are arranged next to each other above (on the Z-direction side of) the sheet feeding devices 20. Each photoconductor unit 30 includes a rotatable photoconductor drum 31, which serves as an image carrier. A charging roller 32, an exposure device LH, a developing unit 40, a first transfer roller 52, and a cleaning blade 34 are arranged around the photoconductor drum 31 in that order in the rotation direction of the photoconductor drum 31. A cleaning roller 33, which cleans the surface of the charging roller 32, is arranged so as to face the charging roller 32 and be in contact with the charging roller 32.

The developing unit 40 includes a developing housing 41 that contains developer. The developing housing 41 houses a developing roller 42 arranged so as to face the photoconductor drum 31, and a pair of augers 44 and 45 that are disposed behind and below the developing roller 42 and that stir and transport the developer toward the developing roller 42. A layer regulating member 47, which regulates the layer thickness of the developer, is disposed near the developing roller 42.

Developing units 40 having substantially the same structure except for the color of the developer contained in the developing housing 41 are provided to form yellow (Y), magenta (M), cyan (C), and black (K) toner images.

The surface of each photoconductor drum 31 that rotates is charged by the charging roller 32, and an electrostatic latent image is formed on the surface of the photoconductor drum 31 by latent-image forming light emitted from the exposure device LH. The electrostatic latent image formed on the photoconductor drum 31 is developed into a toner image by the developing roller 42.

The transfer device 50 includes an intermediate transfer belt 51, first transfer rollers 52, and a second transfer roller 53. The toner images of the respective colors formed on the photoconductor drums 31 of the photoconductor units 30 are transferred onto the intermediate transfer belt 51 in a superposed manner. The first transfer rollers 52 successively transfer the toner images of the respective colors formed by the photoconductor units 30 onto the intermediate transfer belt 51 (first transfer process). The second transfer roller 53 simultaneously transfers the toner images of the respective colors that have been transferred onto the intermediate transfer belt 51 in a superposed manner onto a sheet P (second transfer process).

The toner images of the respective colors formed on the photoconductor drums 31 of the photoconductor units 30 are successively electrostatically transferred onto the intermediate transfer belt 51 by the first transfer rollers 52, which serve as electricity receiving members and receive a predetermined transfer voltage (first transfer process). Thus, a superposed toner image in which the toner images of the respective colors are superposed is formed.

The intermediate transfer belt 51 is moved so that the superposed toner image on the intermediate transfer belt 51 is transported to the region in which the second transfer roller 53 is disposed (second transfer region T). One of the sheet feeding devices 20 supplies a sheet P to the second transfer region T at the time when the superposed toner image reaches the second transfer region T. The second transfer roller 53 receives a predetermined transfer voltage so that the superposed toner image on the intermediate transfer belt 51 is transferred onto the sheet P fed from the pair of registration rollers 23 and guided by a transport guide.

The toner that remains on the surface of each photoconductor drum 31 is removed by the cleaning blade 34 and collected in a waste developer container. Then, the surface of the photoconductor drum 31 is charged again by the charging roller 32. Substances that have not been removed by the cleaning blade 34 and adhered to the charging roller 32 are caught on the surface of the cleaning roller 33 that rotates while being in contact with the charging roller 32, and are accumulated.

The fixing device 60 includes a heating module 61 and a pressing module 62, and a fixing nip region N (fixing region) is formed in a region in which the heating module 61 and the pressing module 62 are pressed against each other.

The sheet P onto which the toner image has been transferred by the transfer device 50 is transported to the fixing device 60 along the transport guide in a state such that the toner image is not fixed. The sheet P transported to the fixing device 60 is pressed and heated by the pair of modules, which are the heating module 61 and the pressing module 62, so that the toner image is fixed to the sheet P.

The sheet P to which the toner image is fixed is transported by a pair of transport rollers 68 and output from a pair of output rollers 69 to the paper output tray 1*a* on the top surface of the image forming apparatus 1.

2. Structure of Container and Attachment/Detachment Mechanism

Figure 3A:
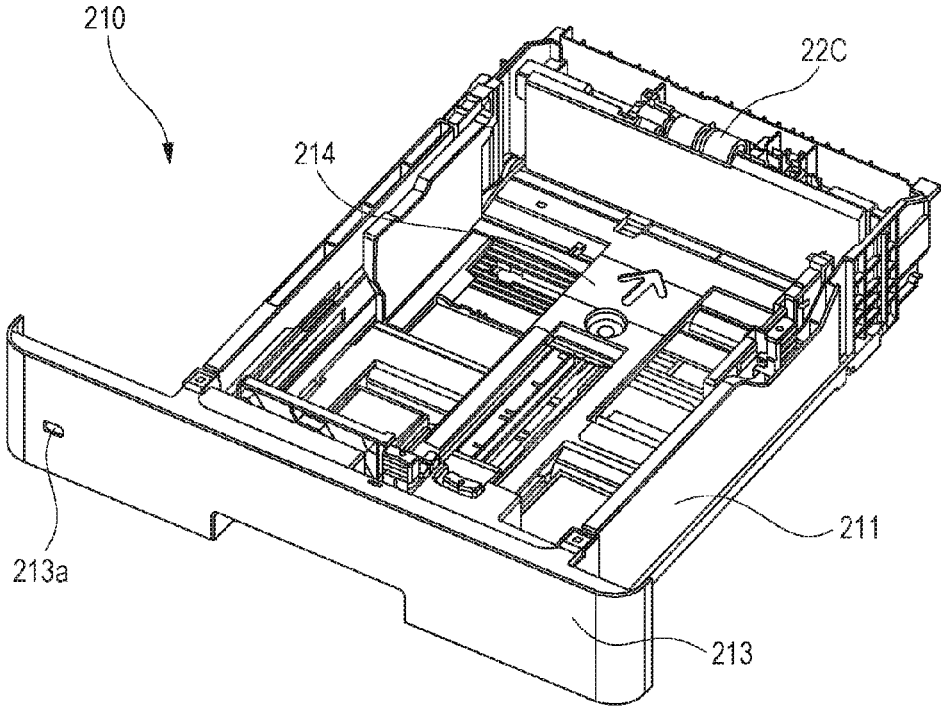
FIG. 3A is a perspective view of a tray in a state in which an auxiliary frame member is retracted.
Figure 3B:
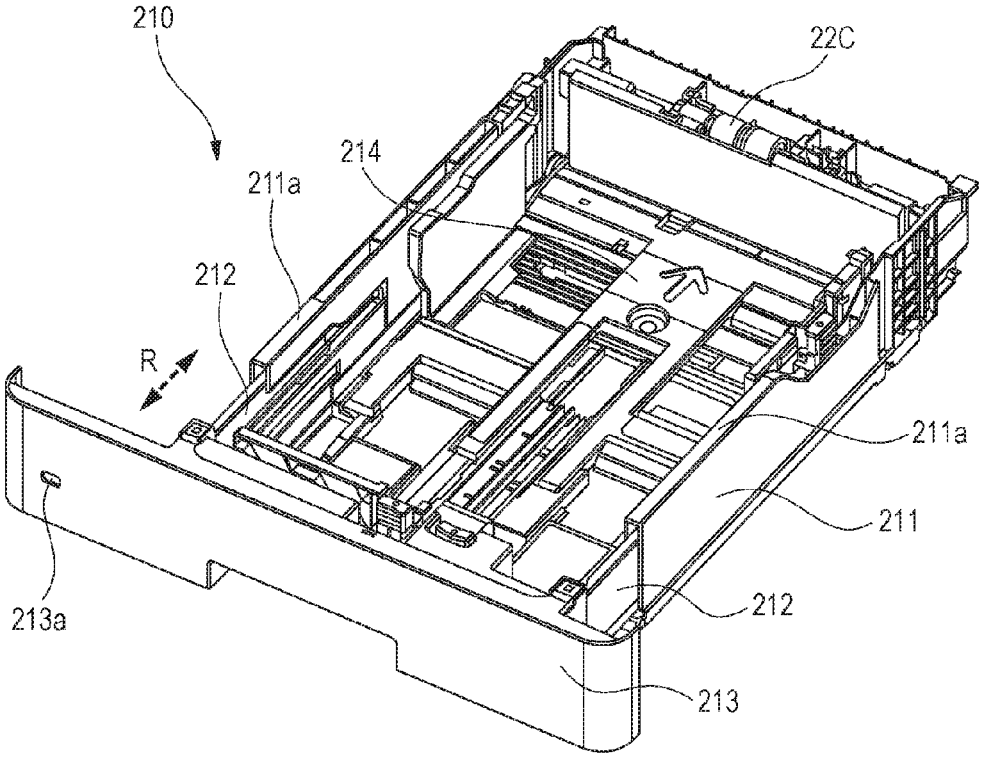
FIG. 3B is a perspective view of the tray in a state in which the auxiliary frame member is pulled out.
Figure 4A:
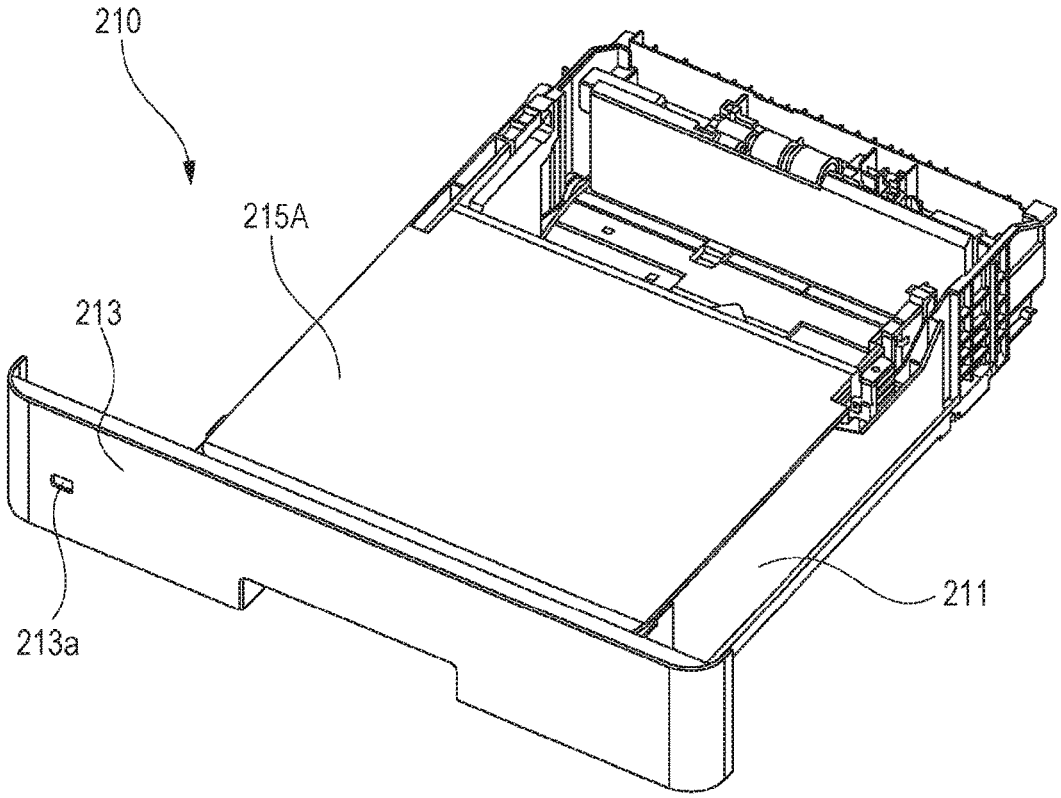
FIG. 4A is a perspective view of the tray in a state in which the auxiliary frame member is retracted and a first cover is attached to the tray.
Figure 4B:
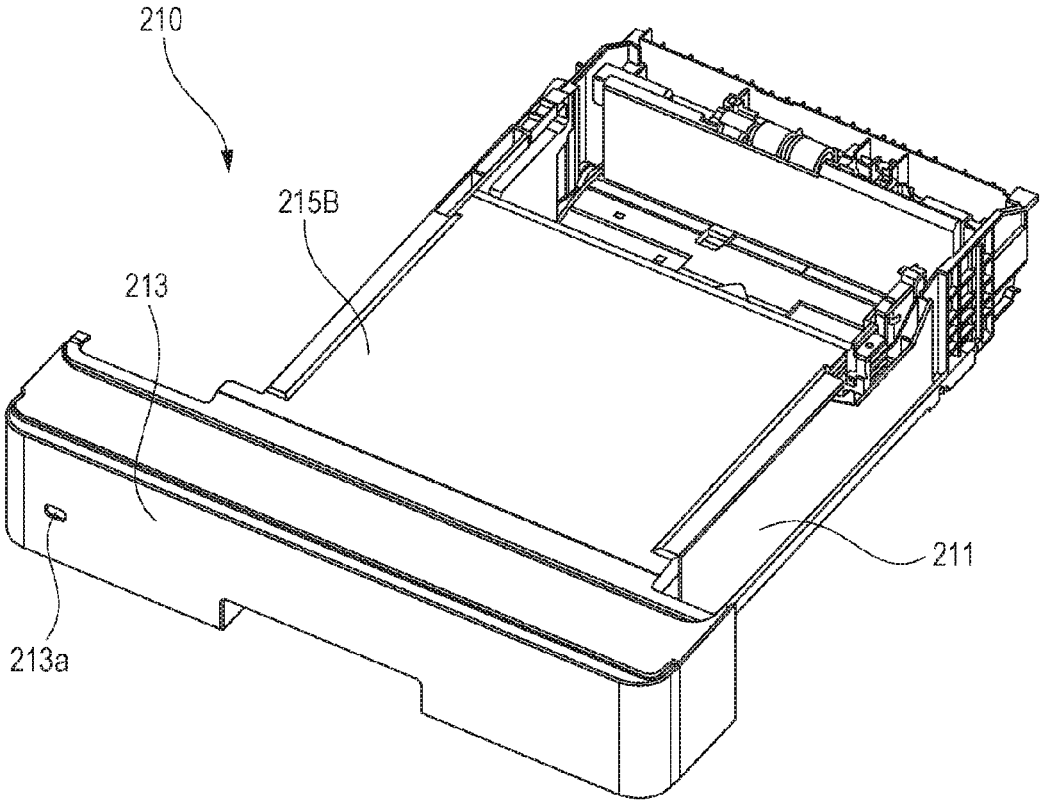
FIG. 4B is a perspective view of the tray in a state in which the auxiliary frame member is pulled out and a second cover is attached to the tray.
Figure 5A:
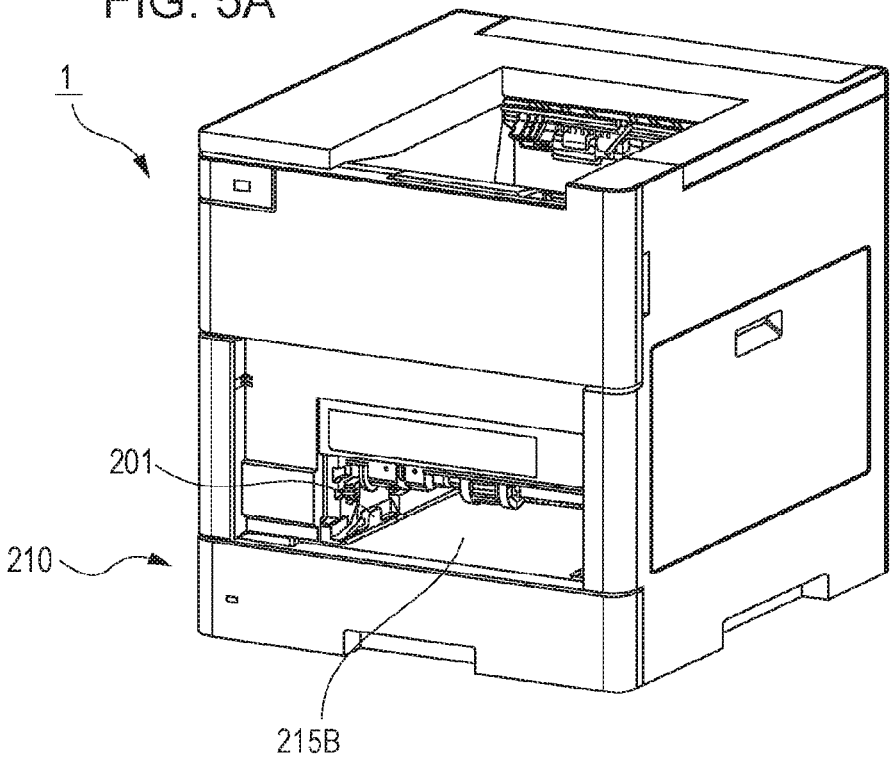
FIG. 5A is a perspective view illustrating the internal structure of the image forming apparatus to which the tray with the first cover is attached.
Figure 5B:
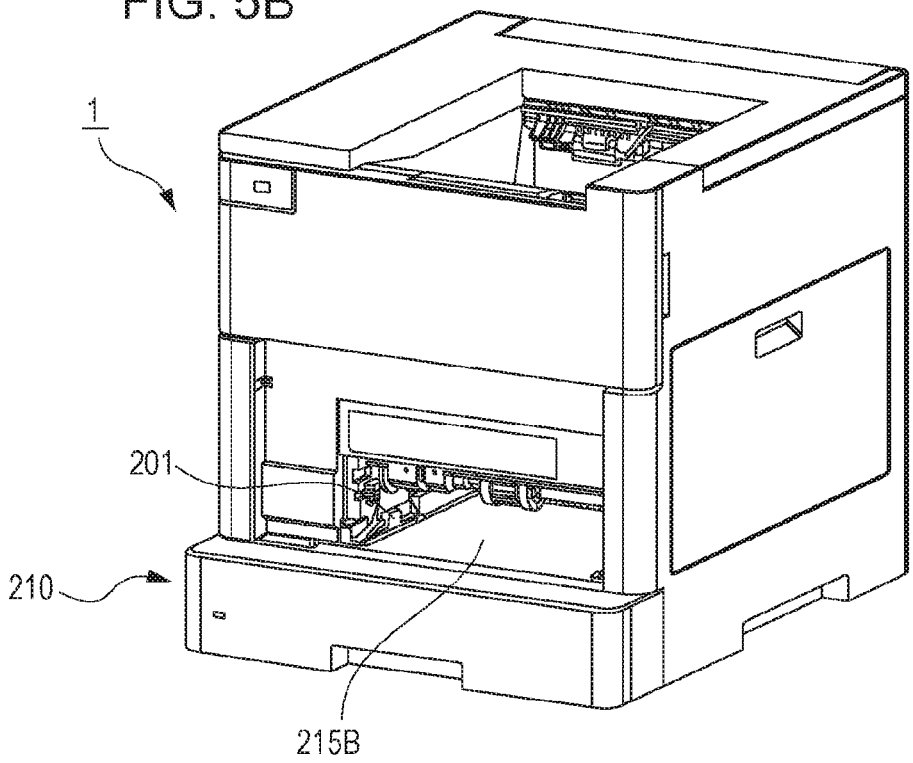
FIG. 5B is a perspective view illustrating the internal structure of the image forming apparatus to which the tray with the second cover is attached.

FIG. 3A is a perspective view of the tray 210 in a state in which the auxiliary frame member 212 is retracted. FIG. 3B is a perspective view of the tray 210 in a state in which the auxiliary frame member 212 is pulled out. FIG. 4A is a perspective view of the tray 210 in a state in which the auxiliary frame member 212 is retracted and a cover member 215A is attached to the tray 210. FIG. 4B is a perspective view of the tray 210 in a state in which the auxiliary frame member 212 is pulled out and a cover member 215B is attached to the tray 210. FIG. 5A is a perspective view illustrating the internal structure of the image forming apparatus 1 to which the tray 210 with the cover member 215A is attached. FIG. 5B is a perspective view illustrating the internal structure of the image forming apparatus 1 to which the tray 210 with the cover member 215B is attached.

The structure of the container will now be described with reference to the drawings.

As illustrated in FIGS. 3A and 3B, the tray 210, which serves as a container, includes the frame 211, the auxiliary frame member 212, a front cover 213, a sheet-receiving plate 214, a cover member 215, and a retard roller 22C.

The frame 211 has the shape of a box capable of receiving the sheets P, and supports the retard roller 22C, which is a component of the sheet drawing unit 22, in a front region in the direction in which the tray 210 is inserted into the body of the sheet feeding device 20. The retard roller 22C is in contact with a feed roller 22B and separates the sheets P fed by a pick-up roller 22A from each other.

The auxiliary frame member 212 includes side portions that may be slid into side portions of the frame 211 (see arrow R in FIG. 3B). The front cover 213 is provided at the front side of the auxiliary frame member 212, and an oblong hole 213*a* is formed at the front side of the front cover 213. The hole 213*a* extends through the front cover 213 and allows a hook portion 113 of a lock 110, which will be described below, to be inserted therethrough. A guide pin 213*b* projects from the back side of the front cover 213, and is fitted to a positioning hole 102, which will be described below, in the body of the sheet feeding device 20 so that the tray 210 is positioned relative to the body.

The tray 210 is switchable between a first state in which the auxiliary frame member 212 is retracted into the frame 211 and a second state in which the auxiliary frame member 212 is pulled out. The tray 210 is set to the first state when, for example, A4 size sheets P (210 mm×297 mm) or letter size sheets P (8.5 inches×11 inches) are to be contained. The tray 210 is set to the first state when, for example, legal size sheets P (8.5 inches×14 inches) are to be contained.

The sheet-receiving plate 214 is provided on a bottom portion of the frame 211 in a swingable state. The sheet-receiving plate 214 swings upward or downward in accordance with the number of sheets P contained so that the sheet P at the top of the stack of sheets P on the sheet-receiving plate 214 is at a constant position relative to the pick-up roller 22A.

As illustrated in FIGS. 4A and 4B, the cover member 215 is a rectangular plate member and may be a first cover member 215A that covers an upper opening of the tray 210 when the auxiliary frame member 212 is retracted, or a second cover member 215B that covers the upper opening of the tray 210 when the auxiliary frame member 212 is pulled out. The cover members 215A and 215B are selectively used depending on the state of the tray 210.

Accordingly, as illustrated in FIGS. 2A and 2B, each tray 210 is disposed such that the front cover 213 thereof does not project from the front surface of the image forming apparatus 1 when the tray 210 is in the first state, and such that the front cover 213 thereof projects from the front surface of the image forming apparatus 1 when the tray 210 is in the second state.

As illustrated in FIGS. 4A and 4B, the cover member 215 is fitted to the top surfaces 211*a* of side walls of the frame 211 so as to cover the upper opening of the frame 211. The tray 210 to which the cover member 215 is fitted is attached to the body of the sheet feeding device 20 by being guided by guide surfaces 201 of the body of the sheet feeding device 20. In this state, the cover member 215 is sandwiched between the top surfaces 211*a* of the side walls of the frame 211 and the guide surfaces 201, so that the contained sheets P cannot be accessed.

3. Container Lock Mechanism

Figure 6A:
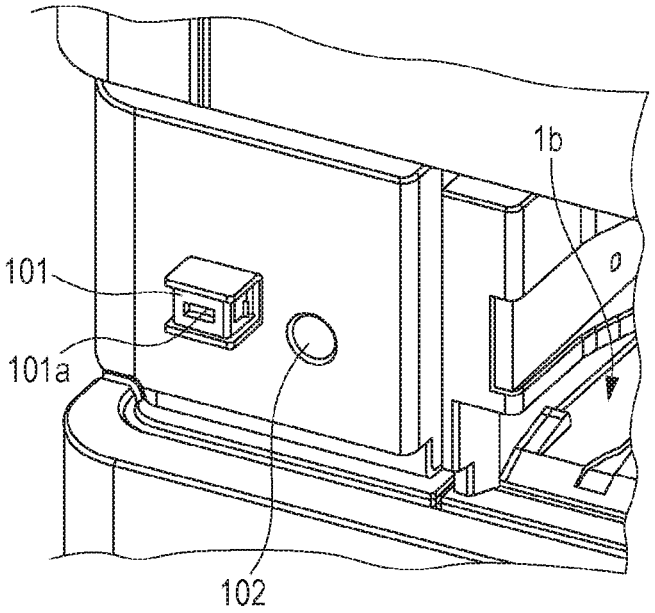
FIG. 6A is a partial perspective view of a body of the sheet feeding device that receives a front cover of the tray.
Figure 6B:
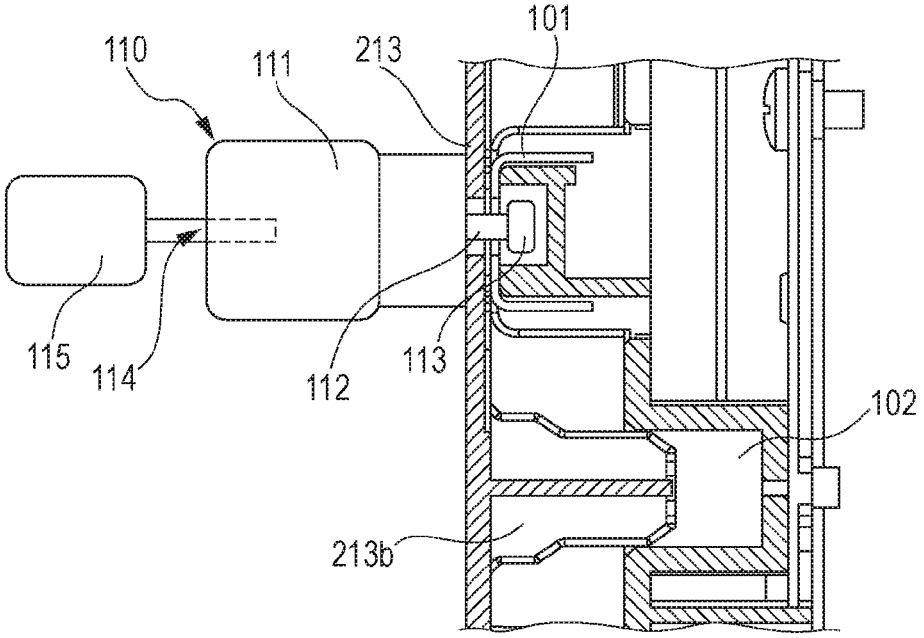
FIG. 6B is a partial sectional view illustrating how the tray is engaged with the body of the sheet feeding device.
Figure 7:
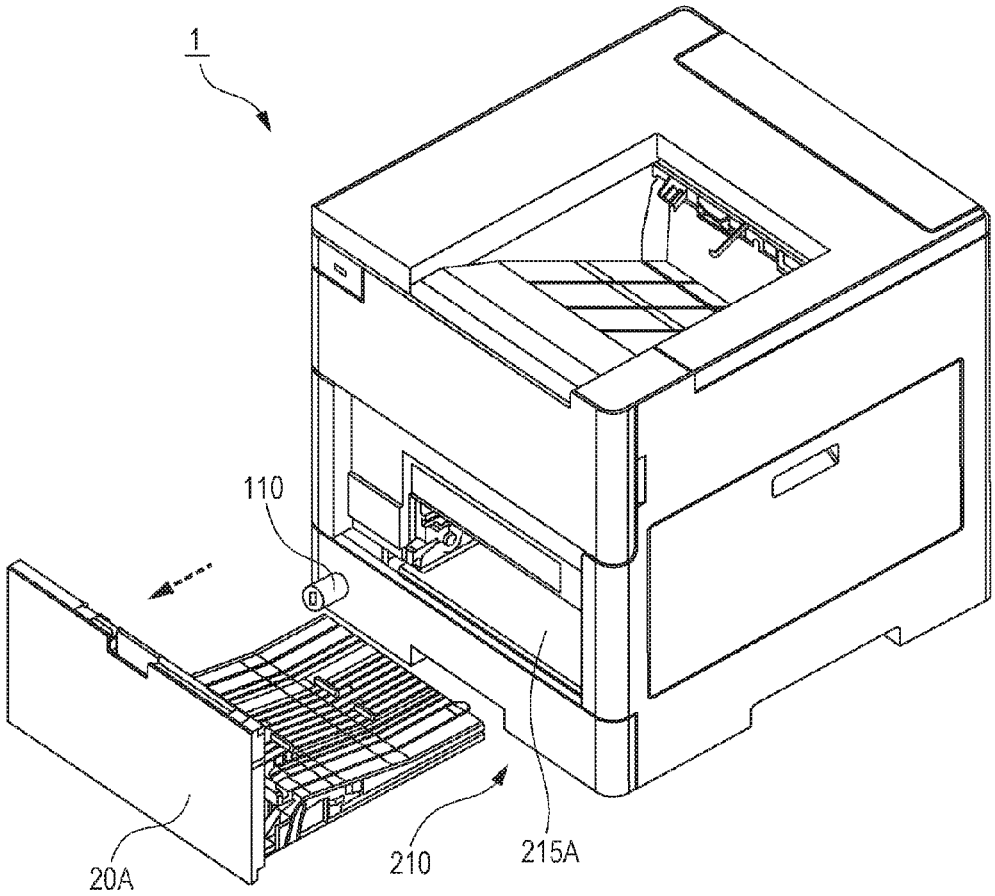
FIG. 7 is a perspective view of the image forming apparatus in a state in which a second sheet feeding device is pulled out.
Figure 8A:
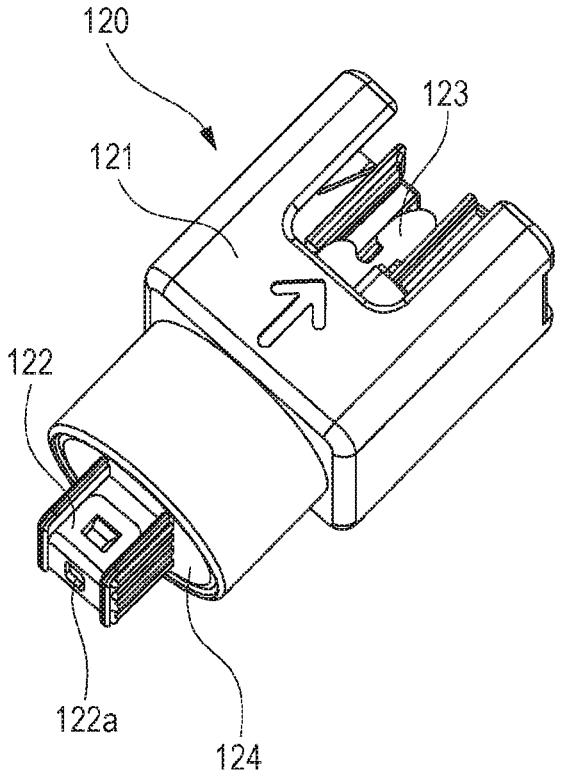
FIG. 8A is a perspective view of a relay member viewed from a plate-member side.
Figure 8B:
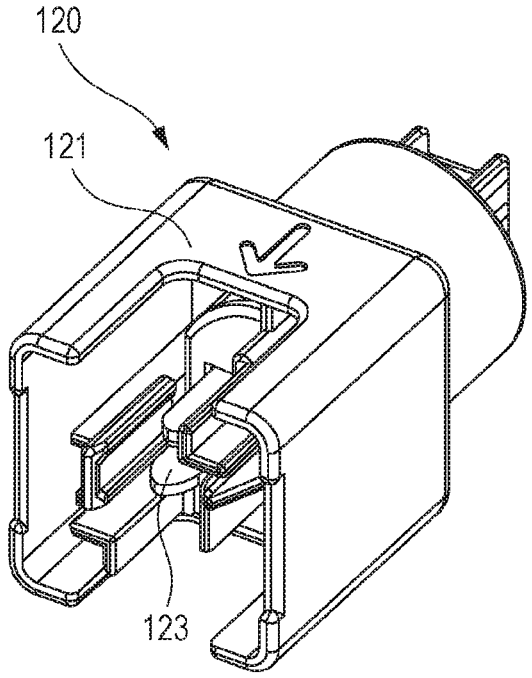
FIG. 8B is a perspective view of the relay member viewed from a hook-member side.
Figure 9A:
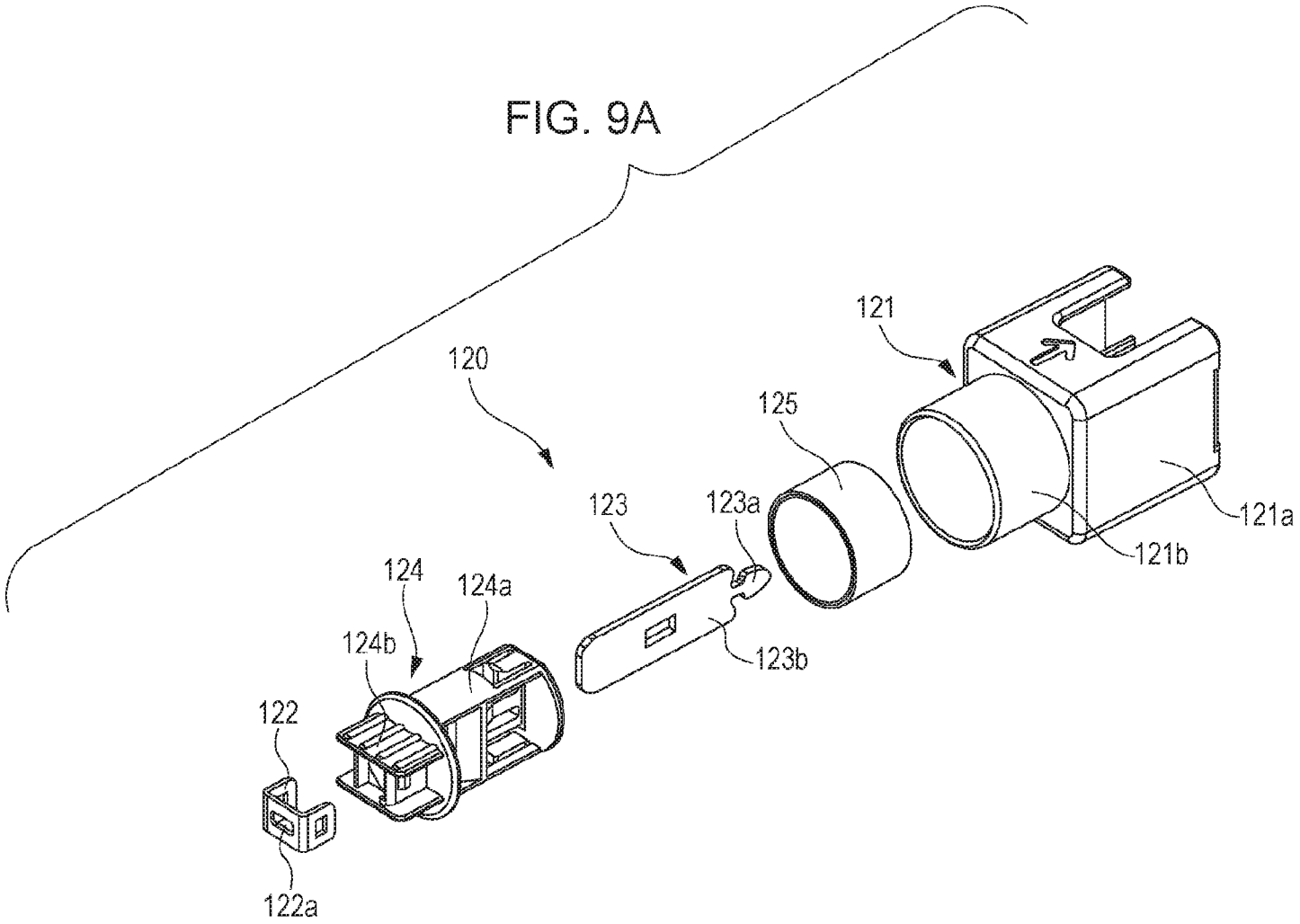
FIG. 9A is an exploded perspective view of the relay member viewed from the plate-member side.
Figure 9B:
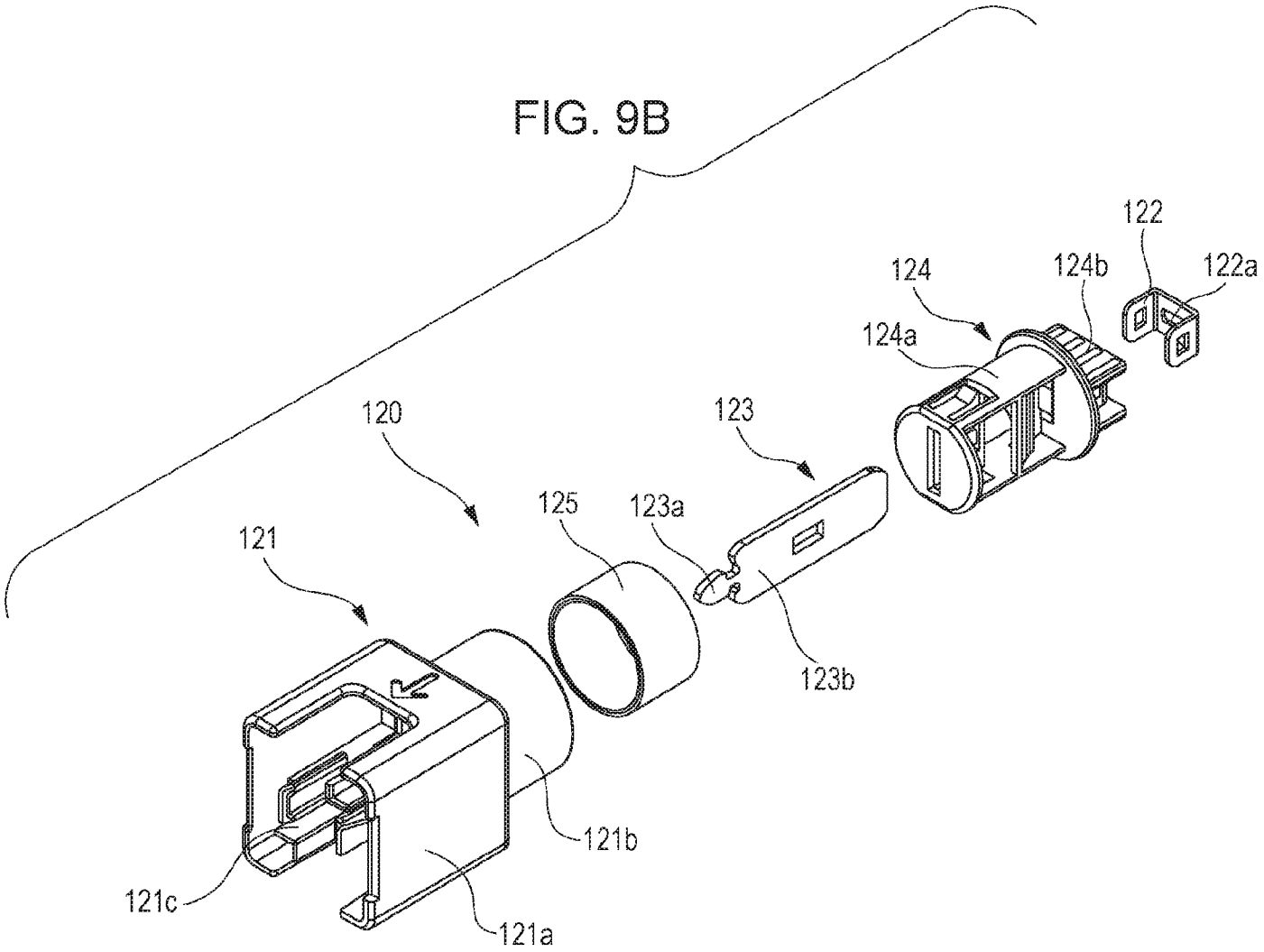
FIG. 9B is an exploded perspective view of the relay member viewed from the hook-member side.
Figure 10A:
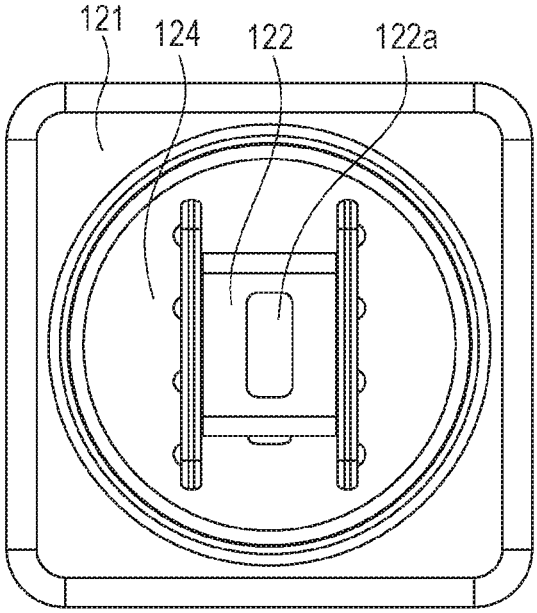
FIG. 10A is a front view of the relay member viewed from the plate-member side.
Figure 10B:
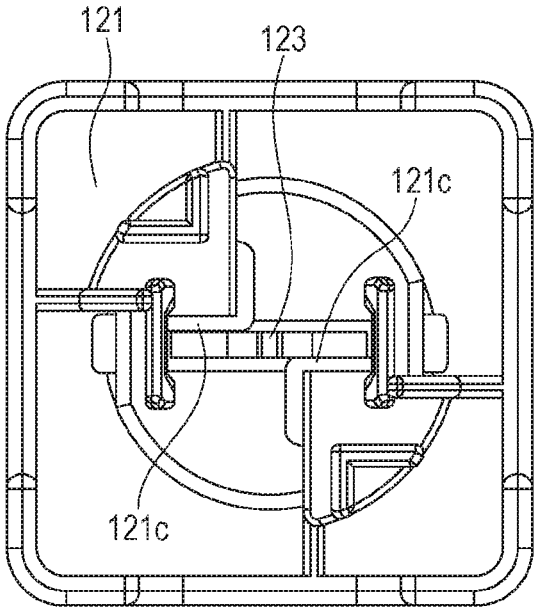
FIG. 10B is a rear view of the relay member viewed from the hook-member side.
Figure 10C:
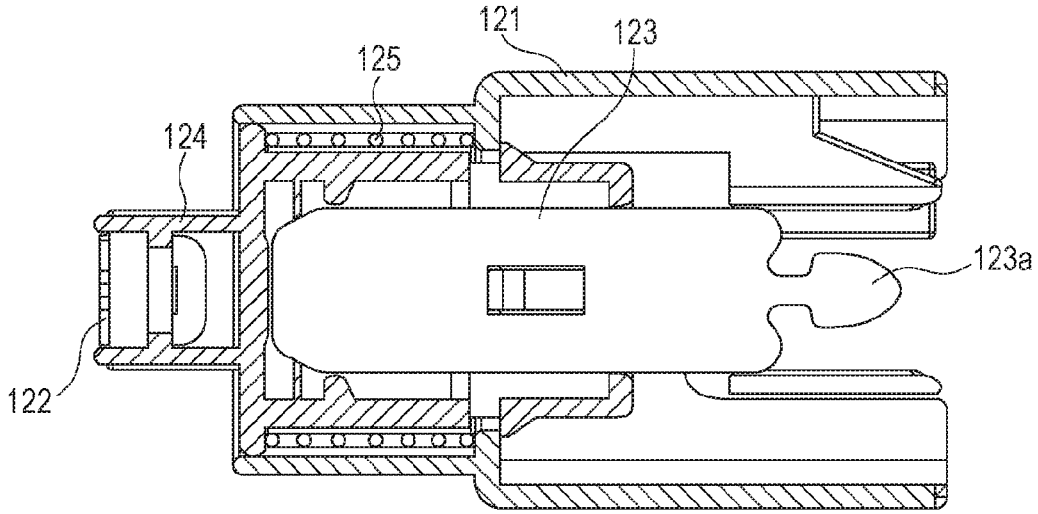
FIG. 10C is a cross-sectional view of the relay member.
Figure 10D:
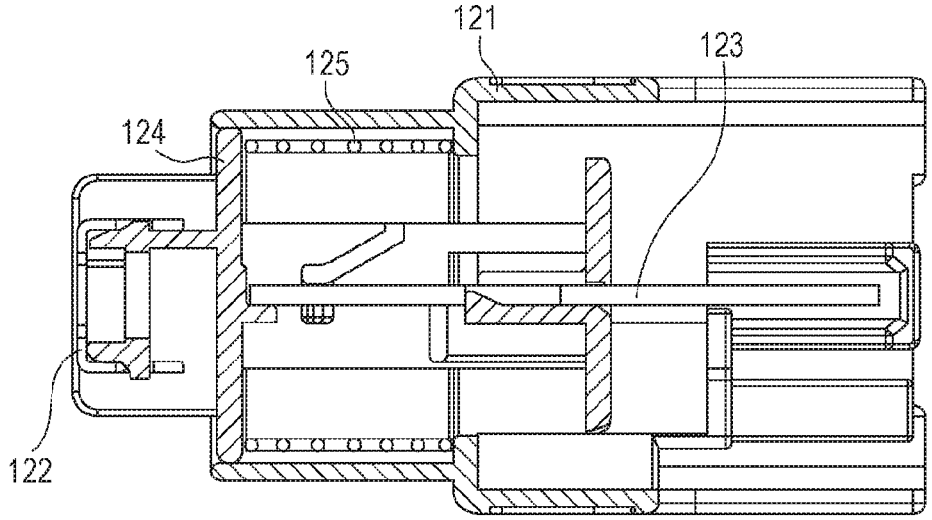
FIG. 10D is a longitudinal sectional view of the relay member.
Figure 11A:
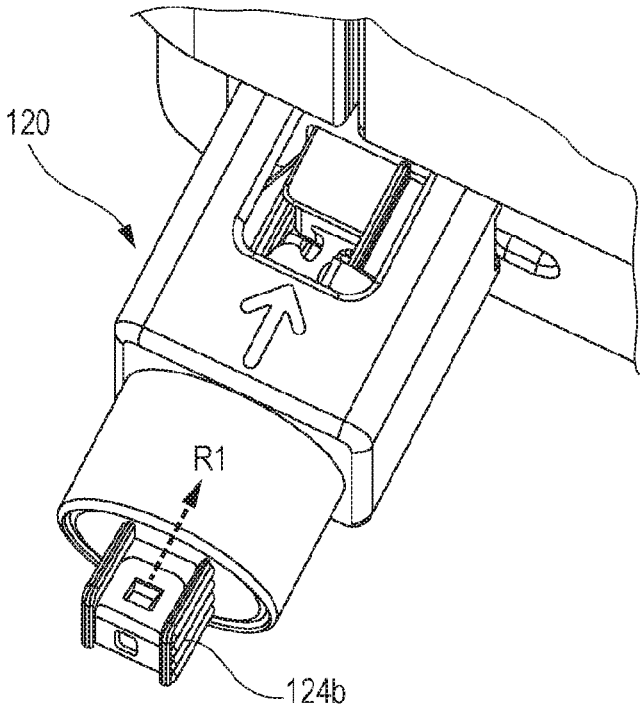
FIGS. 11A to 11C are perspective views illustrating how the relay member is attached to the body of the sheet feeding device.
Figure 11B:
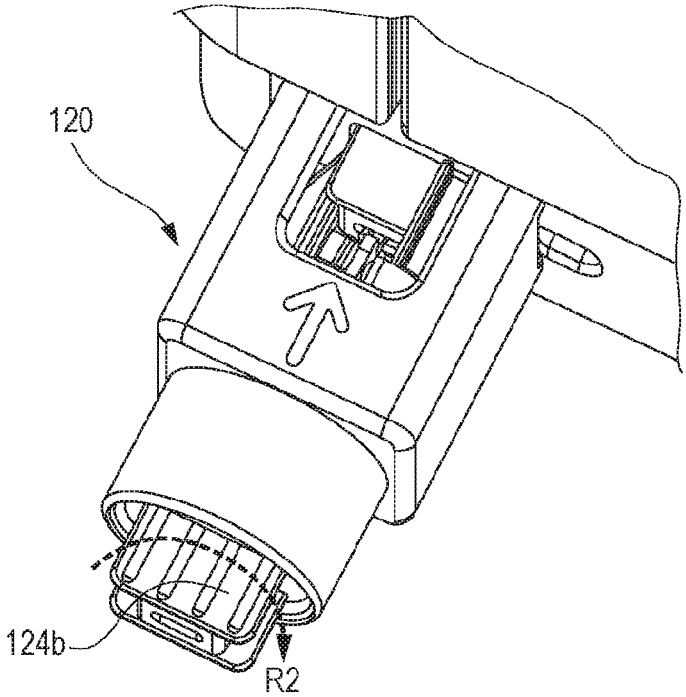
Figure 11C:
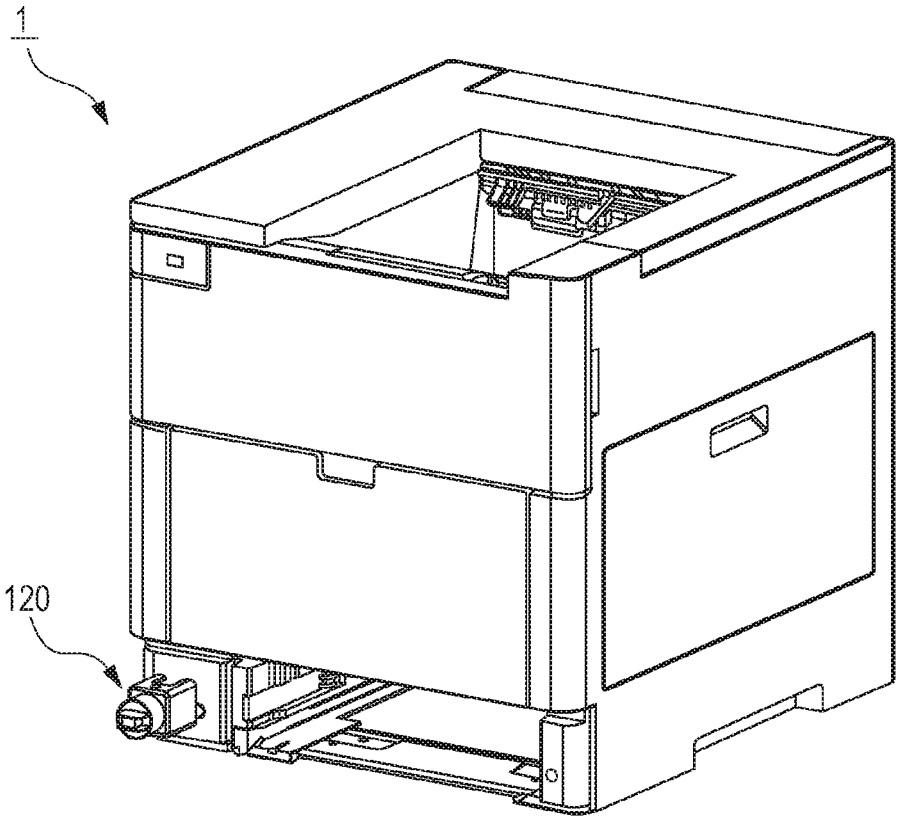
Figure 12A:
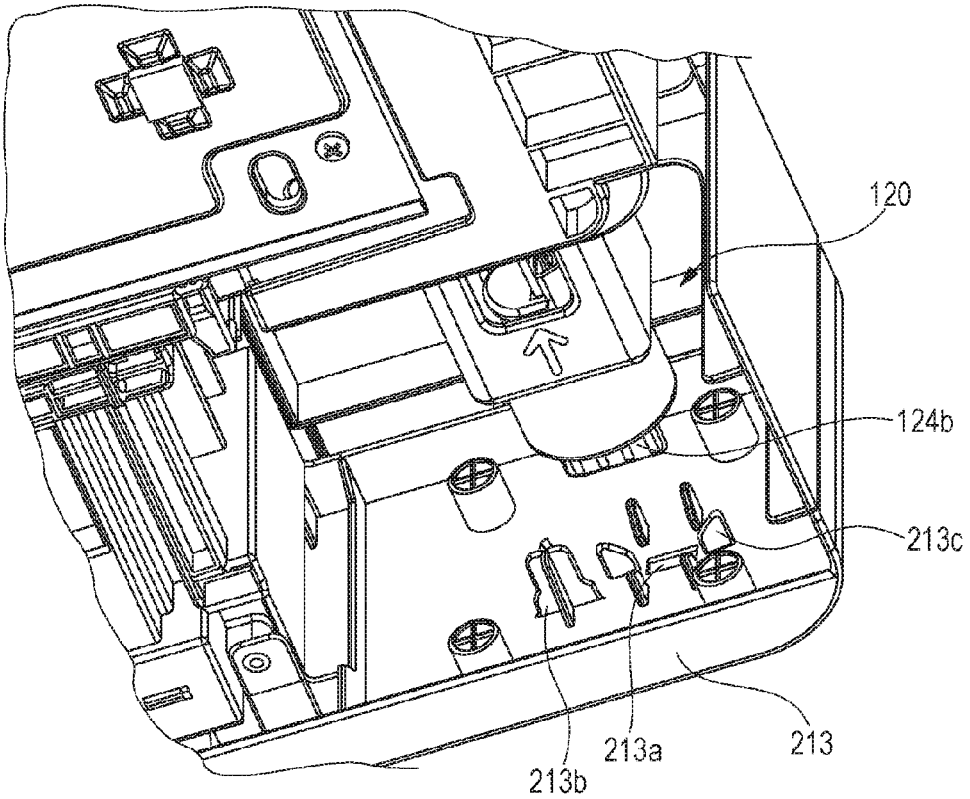
FIG. 12A is a perspective view illustrating how the relay member is connected to the front cover viewed from the bottom side of the sheet feeding device.
Figure 12B:
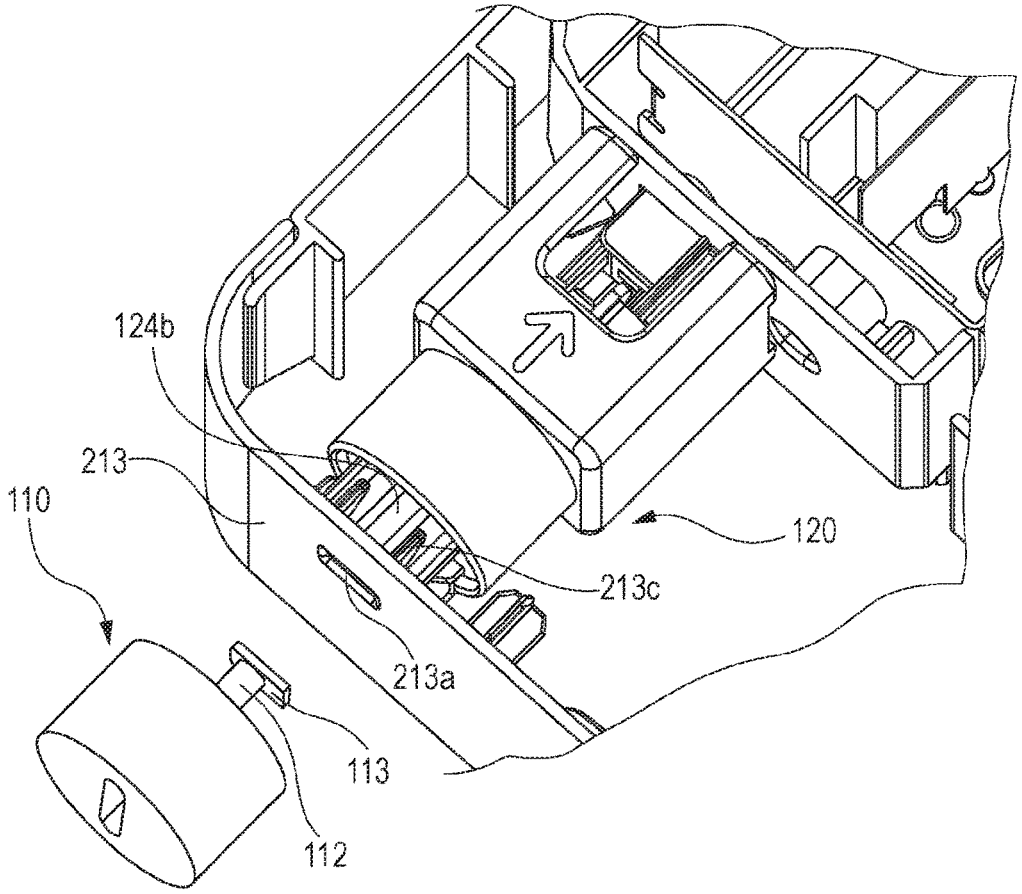
FIG. 12B is a perspective view illustrating how the tray is locked by the relay member.
Figure 13:
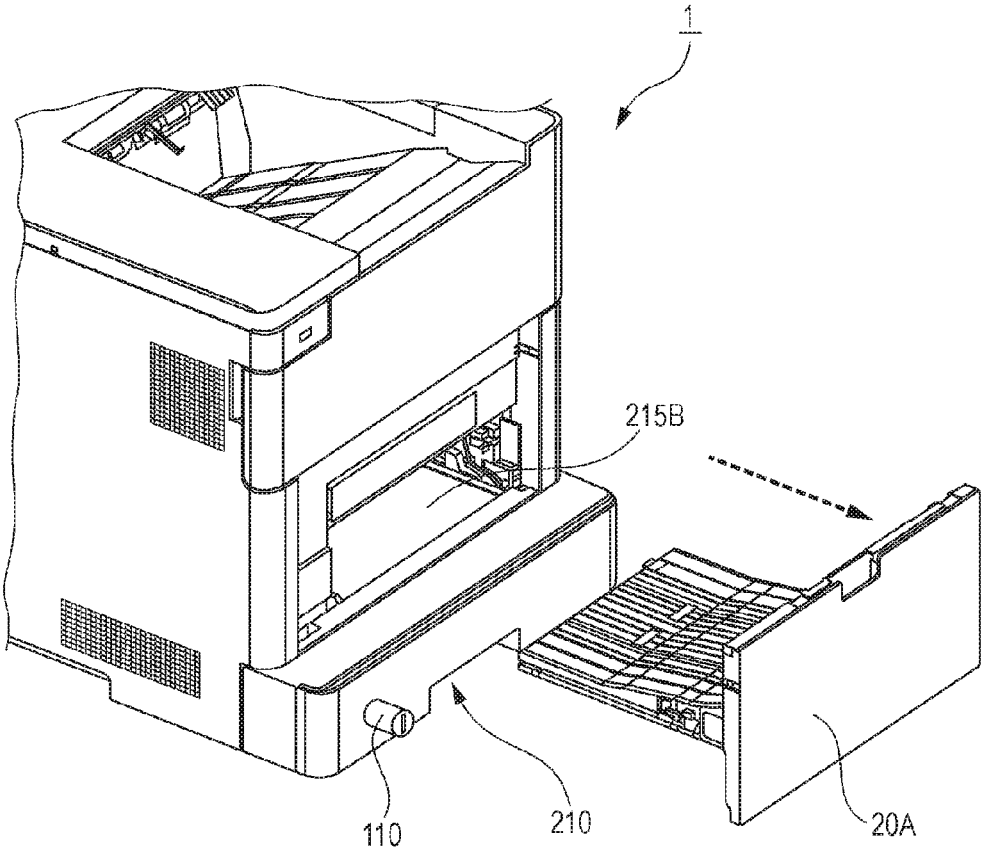
FIG. 13 is a perspective view of the image forming apparatus in a state in which the second sheet feeding device is pulled out.

FIG. 6A is a partial perspective view of the body of the sheet feeding device 20 that receives the front cover 213 of the tray 210. FIG. 6B is a partial sectional view illustrating how the tray 210 is engaged with the body of the sheet feeding device 20. FIG. 7 is a perspective view of the image forming apparatus 1 in a state in which a second sheet feeding device 20A is pulled out. FIG. 8A is a perspective view of a relay member 120 viewed from a plate-member-112 side. FIG. 8B is a perspective view of the relay member 120 viewed from a hook-member-123 side. FIG. 9A is an exploded perspective view of the relay member 120 viewed from the plate-member-122 side. FIG. 9B is an exploded perspective view of the relay member 120 viewed from the hook-member-123 side. FIG. 10A is a front view of the relay member 120 viewed from the plate-member-122 side. FIG. 10B is a rear view of the relay member 120 viewed from the hook-member-123 side. FIG. 10C is a cross-sectional view of the relay member 120. FIG. 10D is a longitudinal sectional view of the relay member 120. FIGS. 11A to 11C are perspective views illustrating how the relay member 120 is attached to the body of the sheet feeding device 20. FIG. 12A is a perspective view illustrating how the relay member 120 is connected to the front cover 213 viewed from the bottom side of the sheet feeding device 20. FIG. 12B is perspective view illustrating how the tray 210 is locked by the relay member 120. FIG. 13 is a perspective view of the image forming apparatus 1 in a state in which the second sheet feeding device 20A is pulled out.

A container attachment/detachment mechanism will be described below with reference to the drawings.

3.1. Body of Sheet Feeding Device 20

As illustrated in FIG. 6A, a bracket 101 is provided on the front surface of the body of the sheet feeding device 20 in a region adjacent to an opening 1*b* through which the tray 210 is inserted or extracted. The bracket 101 is a component of a lock mechanism 100, which serves as a locking unit. The bracket 101 is a metal plate member and is snap-fitted to the body of the sheet feeding device 20. The bracket 101 has an oblong engagement hole 101*a* at one side thereof. The hook portion 113, which is formed on a rod 112 of the lock 110, which will be described below, may be inserted into the engagement hole 101*a* through the hole 213*a* in the front cover 213.

As illustrated in FIGS. 6A and 6B, the positioning hole 102 is formed in a region adjacent to the bracket 101. When the tray 210 is attached to the body of the sheet feeding device 20, the guide pin 213*b* formed on the back surface of the front cover 213 is fitted to the positioning hole 102, so that the tray 210 is positioned relative to the body of the sheet feeding device 20.

As a result, the hole 213*a* in the front cover 213 and the engagement hole 101*a* in the body of the sheet feeding device 20 are positioned so as to overlap and communicate with each other at a location adjacent to the positioning hole 102.

The lock 110, which is inserted into the hole 213*a* in the front cover 213 of the tray 210, includes a cylindrical head portion 111. The hook portion 113 is formed integrally with the rod 112, which projects from one end surface of the head portion 111, at the distal end of the rod 112.

A key hole 114 is formed in the other end surface of the head portion 111. A key 115 is inserted into the key hole 114, and is rotated so that the rod 112 is rotated together.

With this structure, in the case where the tray 210 is in the first state, the rod 112 of the lock 110 is inserted through the hole 213*a* formed in the front cover 213 of the tray 210 and into the engagement hole 101*a* formed in the bracket 101 on the body of the sheet feeding device 20. Then, the key 115 is inserted into the key hole 114 and rotated so that the rod 112 is rotated together. Accordingly, the hook portion 113 engages with the inner wall of the bracket 101 so that the rod 112 cannot be extracted from the engagement hole 101*a*.

As a result, the tray 210 is prevented from being moved in a direction away from the body of the sheet feeding device 20. The tray 210 is secured to the bracket 101 and cannot be pulled out of the body of the sheet feeding device 20.

In the case where the tray 210 cannot be pulled out of the body of the sheet feeding device 20, even when the second sheet feeding device 20A is pulled out of the image forming apparatus 1 as illustrated in FIG. 7, the sheets P contained in the tray 210 cannot be accessed since the cover member 215 is securely sandwiched between the top surfaces 211*a* of the side walls of the frame 211 and the guide surfaces 201 so as to cover the upper opening of the tray 210. As a result, the contained sheets P are protected from theft.

3.2. Relay Member

The relay member 120 includes a housing 121, a plate member 122, a hook member 123, a holder 124, and a spring 125 that serves as an urging member. When the tray 210 is used in the second state in which the auxiliary frame member 212 is pulled out, the relay member 120 is attached to the bracket 101 on the body of the sheet feeding device 20 so that the relay member 120 comes into contact with the front cover 213.

The housing 121 includes a box-shaped body portion 121*a* and a hollow cylindrical portion 121*b* attached to the body portion 121*a* at one end thereof. The cylindrical portion 121*b* supports the holder 124, which will be described below, in a rotatable manner and contains the spring 125 therein so that the holder 124 is supported in a movable manner.

The body portion 121*a* supports the hook member 123, which will be described below, in a movable manner. The body portion 121*a* is open at the other end so that a hook portion 123*a* formed at an end of the hook member 123, which moves together with the holder 124, projects from the open end (see FIG. 8B).

The plate member 122 is made of a metal, and is snap-fitted to a projection formed on the holder 124. An oblong lock hole 122*a* is formed in a surface of the plate member 122. The hook portion 113 formed on the rod 112 of the lock 110, which will be described below, is inserted into the lock hole 122*a* through the hole 213*a* in the front cover 213.

The hook member 123 is a metal plate member, and includes the hook portion 123*a*, which is hook-shaped, at an end thereof. The hook member 123 is fixed to the holder 124, and is supported in the housing 121 such that the hook member 123 is movable together with the holder 124.

The holder 124 includes a cylindrical body portion 124*a*, in which the hook member 123 is secured, and a holding portion 124*b* to which the plate member 122 having the lock hole 122*a* is fixed. The holder 124 is supported such that the holder 124 is rotatable and movable in the housing 121.

The holder 124 is urged by the spring 125 in the housing 121 in a direction in which the holding portion 124*b* to which the plate member 122 is fixed projects from the cylindrical portion 121*b* of the housing 121.

Referring to FIGS. 11A to 11C, the holding portion 124*b* is held and pressed (see arrow R1 in FIG. 11A) so that the hook portion 123*a* of the hook member 123 is inserted into the engagement hole 101*a* in the bracket 101 on the body of the sheet feeding device 20, and then the holding portion 124*b* is rotated (see arrow R2 in FIG. 11B). As a result, the spring 125 in the relay member 120 exerts an urging force so that the hook portion 123*a* of the hook member 123 comes into close contact with bracket 101 on the body of the sheet feeding device 20 and engages with the bracket.

As illustrated in FIG. 10B, the body portion 121*a* of the housing 121 has two receiving portions 121*c* that project radially inward. When the rod 112 of the lock 110 is rotated, plate surfaces 123*b* of the hook member 123 that is also rotated come into contact with the receiving portions 121*c* so that the hook member 123 stops rotating at a predetermined position. In the present exemplary embodiment, the plate surfaces 123*b* of the hook member 123 come into contact with the receiving portions 121*c* when the rod 112 rotates a quarter turn.

With this structure, when the tray 210 in the second state, in which the auxiliary frame member 212 is pulled out, is to be attached to the body of the sheet feeding device 20, first, the relay member 120 is fixed to the body of the sheet feeding device 20 (see FIG. 11C).

Next, the tray 210 is inserted into the body of the sheet feeding device 20. Accordingly, plural ribs 213*c* formed on the back side of the front cover 213 surrounds the holding portion 124*b* of the relay member 120 (see FIG. 12A) so that the holding portion 124*b* is held in a non-rotatable manner. In this state, the hole 213*a* in the front cover 213 and the lock hole 122*a* in the plate member 122 overlap.

Then, as illustrated in FIG. 12B, the rod 112 of the lock 110 is inserted into the lock hole 122*a* in the plate member 122 through the hole 213*a* in the front cover 213. Then, the key 115 is inserted into the key hole 114 and rotated so that the rod 112 is rotated together. Accordingly, the hook portion 113 engages with the inner wall of the plate member 122, so that the rod 112 cannot be pulled out of the lock hole 122*a*.

As a result, the tray 210 is prevented from being moved in a direction away from the body of the device. The tray 210 is secured to the plate member 122 and cannot be pulled out of the body of the sheet feeding device 20.

In the case where the tray 210 cannot be pulled out of the body of the sheet feeding device 20, even when the second sheet feeding device 20A is pulled out of the image forming apparatus 1 as illustrated in FIG. 13, the sheets P contained in the tray 210 cannot be accessed since the cover member 215 is securely sandwiched between the top surfaces 211*a* of the side walls of the frame 211 and the guide surfaces 201 so as to cover the upper opening of the tray 210. As a result, the contained sheets P are protected from theft.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet feeding device comprising:

a container including:

a frame;

an auxiliary frame member provided on the frame so as to be slidable relative to the frame; and a front cover that covers a front side of the auxiliary frame member, the container being detachably supported in a body of the sheet feeding device;

a cover member that covers a top side of the container when the container is attached to the body; and a locking unit comprising a key which is configured to be separated from the front cover, wherein the locking unit is configured to prevent the container attached to the body from being detached from the body when the container is locked, and wherein the locking unit enables the container to be detached from the body when the container is not locked, wherein the locking unit includes:

a bracket attached to the body at the one side;

an engagement hole formed in the bracket; and a lock including a hook formed on a rod that is inserted into the engagement hole through a hole formed in the front cover of the container, the hook engaging with the engagement hole.

2. The sheet feeding device according to claim 1, wherein the cover member is sandwiched between the frame and a guide surface that is provided on the body and that is configured to guide the container when the container is attached or detached.

3. The sheet feeding device according to claim 1, wherein an engagement projection formed so as to project from a back side of the front cover is fitted to an engagement hole formed in the body at one side of the body, so that the container is positioned relative to the body.

4. The sheet feeding device according to claim 1, wherein the locking unit is configured to, when the container is attached to the body in such a state that the auxiliary frame member is pulled out, lock the container by using a relay member so that the container is undetachable from the body, the relay member having a lock hole at one end and engaging with an engagement hole formed in the body at the other end.

5. The sheet feeding device according to claim 4, wherein the relay member includes:

a housing;

a plate member having the lock hole formed in one surface thereof;

a hook member that is hook-shaped at an end thereof;

a holder configured to hold the plate member at one end and to which the hook member is fixed at the other end, the holder being supported in the housing in a rotatable and movable manner, and an urging member configured to urge the holder so that the plate member projects from the housing toward the container.

6. The sheet feeding device according to claim 5, wherein the relay member is configured such that the hook member engages with the engagement hole formed in the body when the holder is rotated and such that the holder is held in a non-rotatable manner when the holder is surrounded by a rib formed on the back side of the front cover.

7. An image forming apparatus comprising:

an image forming unit configured to form an image on a recording material; and the sheet feeding device according to claim 1 that contains the recording material and is configured to supply the recording material to the image forming unit.

8. A sheet feeding device comprising:

a container including:

a frame;

an auxiliary frame member provided on the frame so as to be slidable relative to the frame; and a front cover that covers a front side of the auxiliary frame member, the container being detachably supported in a body of the sheet feeding device;

a cover member that covers a top side of the container when the container is attached to the body; and a locking unit configured to prevent the container attached to the body from being detached from the body when the container is locked and that enables the container to be detached from the body when the container is not locked, wherein the locking unit includes:

a bracket attached to the body at the one side;

an engagement hole formed in the bracket; and a lock including a hook formed on a rod that is inserted into the engagement hole through a hole formed in the front cover of the container, the hook engaging with the engagement hole.

9. The sheet feeding device according to claim 1, wherein the key is configured to be rotated to thereby lock the container and prevent the container attached to the body from being detached from the body.

* * * * *